United States Patent [19]

Cherny et al.

[11] 3,948,647

[45] Apr. 6, 1976

[54] METHOD OF MELTING SOLID IRON IN A GAS CUPOLA

[76] Inventors: Anatoly Alexeevich Cherny, ulitsa Stavy 7, kv. 40; Vladimir Alexandrovich Grachev, ulitsa Odesskaya, 6, kv. 54; Evgeny Mikhailovich Kirin, ulitsa Suvorova, 166, kv. 9; Nikolai Andreevich Gorelov, ulitsa Ulyanovskaya, 8, kv. 65, all of Penza, U.S.S.R.

[22] Filed: June 18, 1975

[21] Appl. No.: 587,876

Related U.S. Application Data

[63] Continuation of Ser. No. 447,030, Feb. 28, 1974, abandoned.

[30] Foreign Application Priority Data

Mar. 27, 1973 U.S.S.R. ..... 1900192

[52] U.S. Cl. ..... 75/43; 75/95

[51] Int. Cl.[2] ..... C21B 11/02

[58] Field of Search ..... 75/43, 44 R, 44 S, 95

[56] References Cited

UNITED STATES PATENTS

| | | | |
|---|---|---|---|
| 1,849,502 | 3/1932 | Merten | 75/43 |
| 3,820,978 | 6/1974 | Magoteaux | 75/95 |

*Primary Examiner*—M. J. Andrews

*Attorney, Agent, or Firm*—Holman & Stern

[57] ABSTRACT

A gas cupola is continuously charged with solid iron to be melted. Upon completion of the solid iron charging, the cupola is charged with a refractory material in a quantity required to provide a layer over the surface of the iron being melted. The proposed method has avoided losses of iron during its melting and, in addition, it has been made possible to carry out a sequence of iron melting operations without preliminary repairs of the cupola refractory lining before each heat.

4 Claims, 1 Drawing Figure

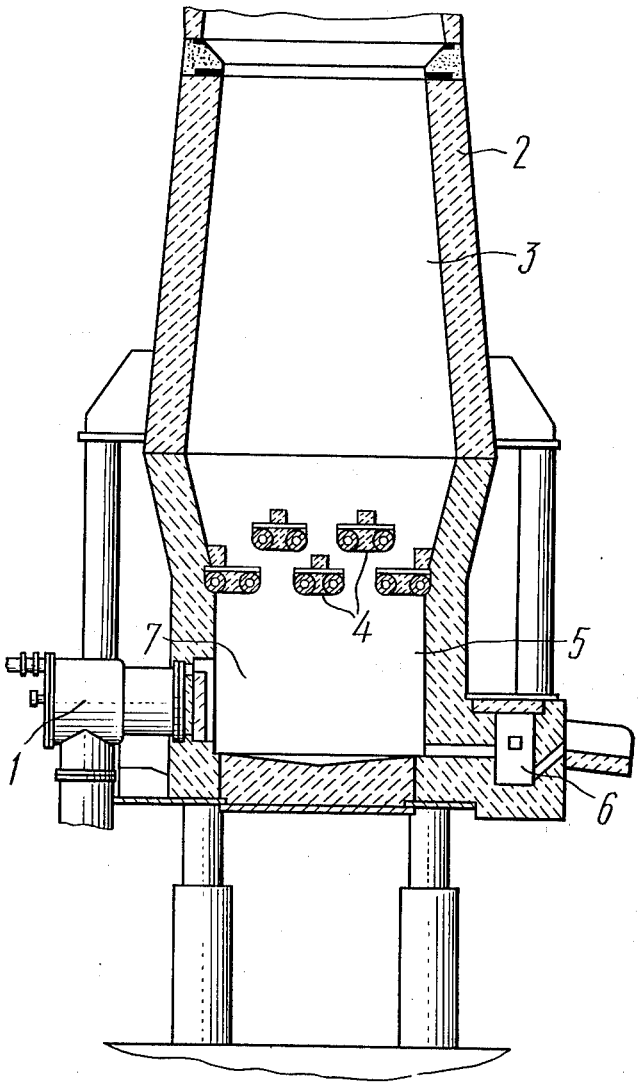
2
3
4
5
6
7
1

METHOD OF MELTING SOLID IRON IN A GAS CUPOLA

This is a continuation of application Ser. No. 447,030 filed Feb. 28, 1974, now abandoned.

BACKGROUND OF THE INVENTION

The present invention relates to the iron and steel industry and, more particularly, to a method of melting solid iron in a gas cupola.

At present, when melting solid iron in a gas cupola a temperature exceeding the iron melting temperature is created in the cupola shaft, and then the cupola is charged with a burden consisting of solid iron and fluxes.

Charging of the above burden is carried out continuously which provides for a constant level of the burden to be maintained in the cupola.

The temperature required to conduct the iron melting operation is obtained due to the released heat of gases burnt in a gas burner arranged at the cupola shaft bottom.

Under the effect of the heat released by the gases, melting of the burden lower layer occurs, with the molten iron being continuously tapped from the cupola.

This well-known technique, however, has an essential disadvantage consisting in that at the end of the melting operation when the burden supply is stopped, at the cupola shaft bottom there appears a sow formed of metals and their oxides. This sow making up to 10 per cent of the solid iron charged is scrapped. Moreover, the sow hinders the gases passing into the cupola shaft which reduces the intensity of melting and decreases the cupola's productivity. Therefore, it is necessary to remove the sow when preparing the cupola for a next heat which results in damaging the refractory lining around the sow.

SUMMARY OF THE INVENTION

It is, therefore, an object of the present invention to overcome the above mentioned disadvantages.

Another object of the present invention is to provide a method of melting solid iron with minimum losses.

Still another object of the present invention is to provide a method of melting solid iron without any preliminary repairs of the cupola refractory lining. These objects are achieved by a method of melting solid iron in a gas cupola, according to the invention, in which upon completion of charging solid iron into the cupola, a refractory material in a quantity required to provide a layer over the surface of the iron being melted is charged into the cupola.

It is preferable that the depth of the refractory material layer be not less than 0.3 of the cupola shaft diameter.

The present method has made it possible to eliminate sow formation and thus to reduce iron losses during melting and in addition, this method has enabled a sequence of solid iron melting operations to be conducted without any repairs of the cupola refractory lining before each heat.

Below is given a detailed description of the method of melting solid iron in a gas cupola from which description, the advantages of the present invention will be readily apparent.

The present method consists in that a gas cupola heated to a temperature exceeding the iron melting temperature is continuously charged with a burden including solid iron and fluxes.

The burden is fed at such a rate that its level is maintained constant in the cupola. The heat of gases burnt in a gas burner arranged at the cupola bottom is used to melt the burden's lower layer. Upon completion of charging the burden into the cupola, refractories are charged in quantities required to create a layer over the burden surface. It is preferable that this layer depth be not less than 0.3 of the cupola shaft diameter. The melting of iron applying the above method has permitted the avoidance of sow formation.

It has been found that the formation of sows when using well-known methods of iron melting can be explained by the fact that after the burden supply into the cupola has been stopped, heat-carrying gases break through the burden layer growing gradually thinner due to which the heat of the hot gases is no longer uniformly distributed across the cupola shaft section and dead zones are formed in which the burden is not melted but chilled. As a result of the above, on the cupola shoulders (a gas cupola with shoulders in the shaft), on the cupola dams (a gas cupola with dams in the shaft) or at the hearth (a gas cupola with an outside superheating chamber) there are formed metal sows.

It has been found that sow formation can be eliminated by providing a counterpressure to the breaking-through gases. This is achieved by charging the cupola, upon completion of the burden charging thereinto, with a refractory material such as a fire-clay brick or high alumina refractory, whose layer will provide the counterpressure required.

The hot gas will thus uniformly heat and fully melt the remaining burden without the formation of dead zones.

After complete melting of the burden, partial smelting of the refractory material takes place with its flowing down the cupola sidewalls and solidifying there which results in recovery (building-up) of the cupola refractory lining which has been partially melted during the iron melting operation.

BRIEF DESCRIPTION OF THE DRAWING

The proposed method can be accomplished in a gas cupola of any design, for example in a gas cupola with dams in the shaft as shown in the attached drawing.

DETAILED DESCRIPTION OF THE PREFERRED EMBODIMENT

Prior to the beginning of the melting operation, a burner 1 is fired and a refractory lining 2 of a cupola is heated to a temperature exceeding the iron melting temperature. Thereafter a shaft 3 of the cupola is charged with a burden consisting of solid iron and fluxes. The metallic burden is retained by watercooled dams 4 of the cupola whereupon its melting occurs. The molten iron flowing into a superheater chamber 5 is additionally superheated, and then through a slag separator 6 it overflows into a ladle. The burden is charged into the cupola on a continuous basis. Upon completion of charging, the burden level in the cupola shaft 3 gradually decreases which leads to a decrease in the counterpressure of gases in the superheater chamber 5 and the formation of blown-out areas in which chilling of the molten iron and sow formation take place. In order to prevent the formation of blown-out areas and that of sows in the melting zone, at the end of the melting operation, over the metallic burden is loaded a refractory material with a basicity approaching that of the cupola lining. The depth of the refractory material layer must be not less than 0.3 of the shaft diameter in a melting zone 7 of the cupola. The particle size of the refractory material should be similar to that of the metallic burden. The presence of the refractory material on the metallic burden surface makes it possible to create a counterpressure in the melting zone 7, provide a uniform distribution of hot gases across the cupola section within the melting zone 7 and avoid metal losses due to incomplete melting of the iron. Furthermore, after the metallic burden has been completely melted the refractory material begins to melt and flows down the sidewalls of the shaft 3, and becomes solidified thus providing hot repair of the refractory lining of the superheater chamber 5. Upon turning-off the gas burner 1 and blowing out the cupola shaft 3 with air, a layer of the molten refractory material on the lining of the superheater chamber 5 solidifies forming a monolith.

The given ratio between the depth of the refractory layer and the shaft diameter in the melting zone 7 is optimum since decreasing the depth of the refractory layer (below 0.3 of the melting zone shaft diameter) leads to reducing the counterpressure in the melting zone and reducing the effect.

The basicity of the refractory material should approach that of the cupola refractory lining since a change in the basicity will result in erosion of the cupola wall lining.

What we claim is:

1. A method of melting solid iron in a gas cupola comprising the steps of: heating the cupola to a temperature higher than the iron melting temperature; charging the cupola with a burden comprising solid iron and fluxes to be melted; upon completion of charging the burden, charging the cupola with a refractory material in a quantity required to form a layer over the surface of the burden; melting the burden; upon completion of melting the burden, melting the layer of refractory material; cooling the cupola to solidify the refractory material which provides hot repair of the refractory lining of the cupola.

2. The method as claimed in claim 1 wherein the layer of the refractory material has a depth not less than 0.3 of the cupola shaft diameter.

3. The method as claimed in claim 2 wherein the refractory material comprises a high alumina refractory.

4. The method as claimed in claim 2 wherein the refractory material comprises a fire-clay brick.

* * * * *